US007530844B2

(12) United States Patent
Shen

(10) Patent No.: US 7,530,844 B2
(45) Date of Patent: May 12, 2009

(54) ELECTRICAL CONNECTOR WITH RETAINING MEMBER

(75) Inventor: Guo-Jian Shen, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/004,975

(22) Filed: Dec. 21, 2007

(65) Prior Publication Data

US 2008/0153340 A1 Jun. 26, 2008

(51) Int. Cl.
*H01R 13/40* (2006.01)

(52) U.S. Cl. ..... 439/598

(58) Field of Classification Search ..... 439/903, 439/701, 610, 660, 499, 607
See application file for complete search history.

(56) References Cited

U.S. PATENT DOCUMENTS

| | | | | |
|---|---|---|---|---|
| 3,671,921 | A * | 6/1972 | Baker et al. | 439/353 |
| 5,609,499 | A * | 3/1997 | Tan et al. | 439/445 |
| 6,935,896 | B1 * | 8/2005 | Tsai | 439/607 |
| 7,147,505 | B2 | 12/2006 | Li | |
| 2008/0050968 | A1 * | 2/2008 | Chang | 439/607 |
| 2008/0090457 | A1 * | 4/2008 | Takeuchi | 439/607 |

* cited by examiner

*Primary Examiner*—Phuong K Dinh
(74) *Attorney, Agent, or Firm*—Wei Te Chung

(57) ABSTRACT

An electrical connector (100) includes a connector member (1) providing a plurality of conductive terminals (126) therein, an insulative coat (3) defining a receiving cavity (30) with an open, and a retaining member (2). The connector member includes a base portion received in the receiving cavity (30) and a mating portion (14) extending forward from the base portion and out of the open. The retaining member is fixed in the receiving cavity of the insulative coat to retain the connector member and the insulative coat together steadily.

5 Claims, 6 Drawing Sheets

ELECTRICAL CONNECTOR WITH RETAINING MEMBER

BACKGROUND OF THE INVENTION

1. Field of the invention

The present invention relates to an electrical connector, and more particularly to an electrical connector for connecting with a cable.

2. Description of Related Art

U.S. Pat. No. 7,147,505 discloses a conventional electrical connector for connecting with a cable. The connector includes a connector member providing a plurality of conductive contacts therein, a cable electrically connecting with the connector member at one end, a pair of upper and lower metal shells attached together so as to form a box room to receive one end of the cable and connector member. A pair of latching members, used for locking with a complementary connector, are mounted onto the metal shells. An insulating coat surrounds the shells and provides with a hole for allow a finger of a user to press one end of the locking member to release the engagement of the latching member and the complementary connector.

However, the connector member is fixed into the coat only by the pair of metal shells, which may be result in moving of the connector member, even be loose from the coat during the connector continually being inserted into or pulled out of the complementary connector.

Hence, an improved electrical connector is desired to overcome above problem.

SUMMARY OF THE INVENTION

An object of the present invention is to provide an electrical connector comprising a connector member with conductive terminals wherein and an insulative coat, the connector member can be retained in the coat steadily.

In order to achieve above-mentioned object, an electrical connector comprises a connector member providing a plurality of conductive terminals therein, an insulative coat defining a receiving cavity with an open, and a retaining member; the connector member comprises a base portion received in the receiving cavity and a mating portion extending forward from the base portion and out of the open; the retaining member is fixed in the receiving cavity of the insulative coat to retain the connector member and the insulative coat together steadily.

Other objects, advantages and novel features of the present invention will become more apparent from the following detailed description of the present embodiment when taken in conjunction with the accompanying drawings.

DETAILED DESCRIPTION OF THE INVENTION

Figure 1:
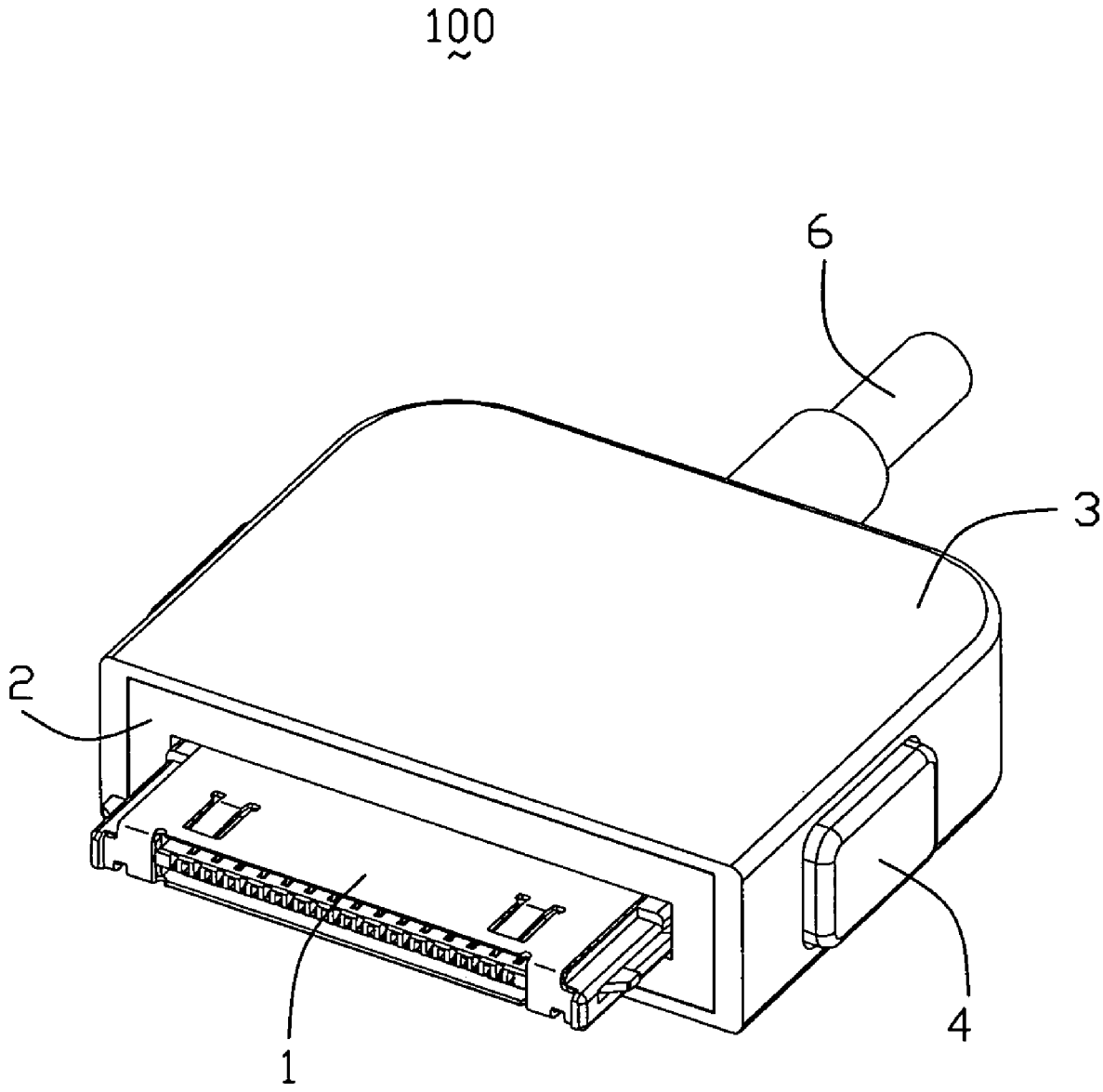
FIG. 1 is a front assembled perspective view of an electrical connector in accordance with the present invention.

Reference will now be made to the drawing figures to describe the preferred embodiment of the present invention in detail.

Figure 2:
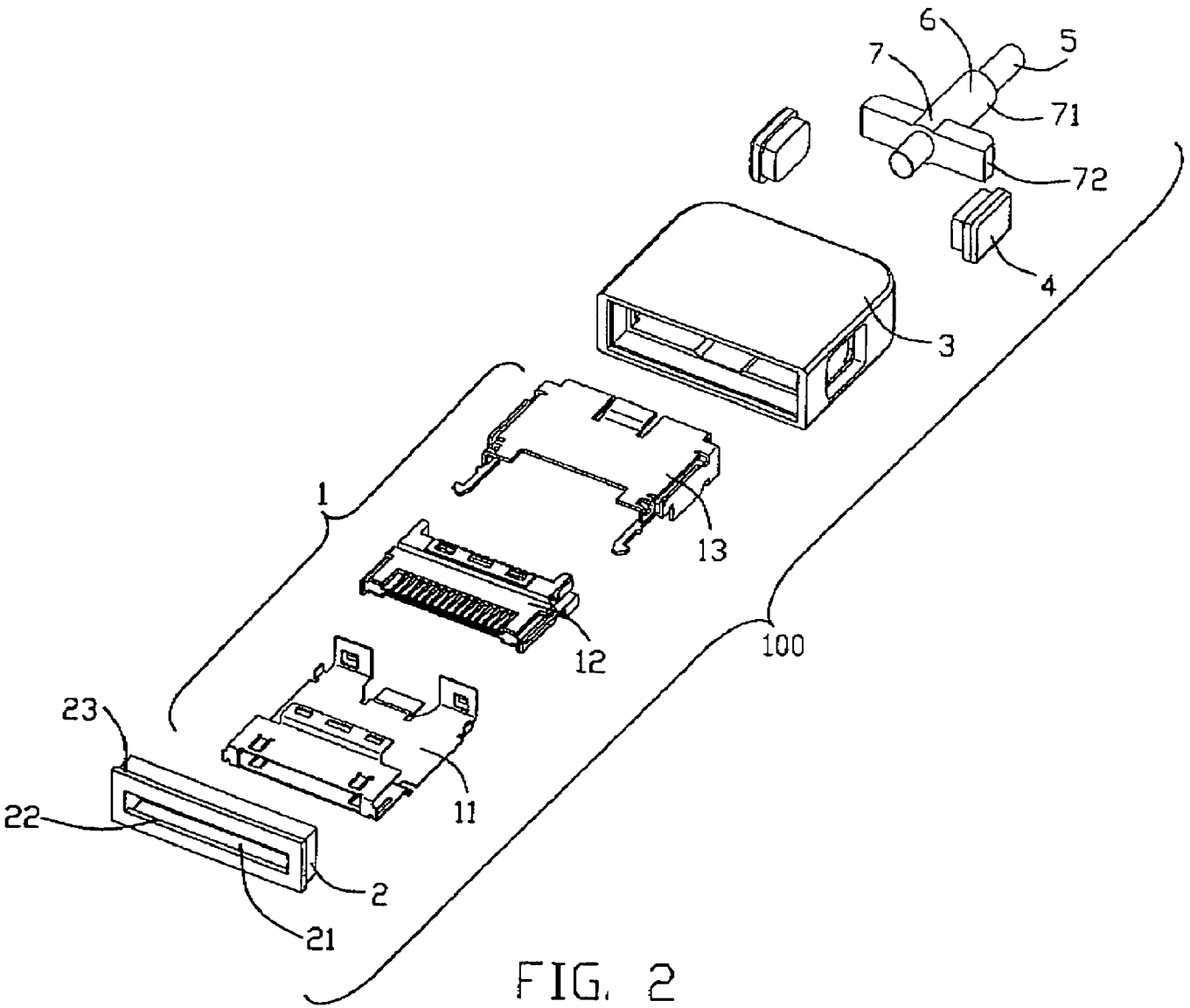
FIG. 2 is an exploded perspective view of the electrical connector of FIG. 1.

Referring to FIGS. 1 and 2, an electrical connector 100 in accordance with the present invention comprises a connector member 1, a retaining member 2, an insulative coat 3, a pressing member 4, and a cable assembly 6 with a cable 5 and a strain relief member 7. The connector member 1 comprises a first shell 11, a second shell 13, and an insulative housing 12 providing a plurality of conductive terminals therein.

Figure 4:
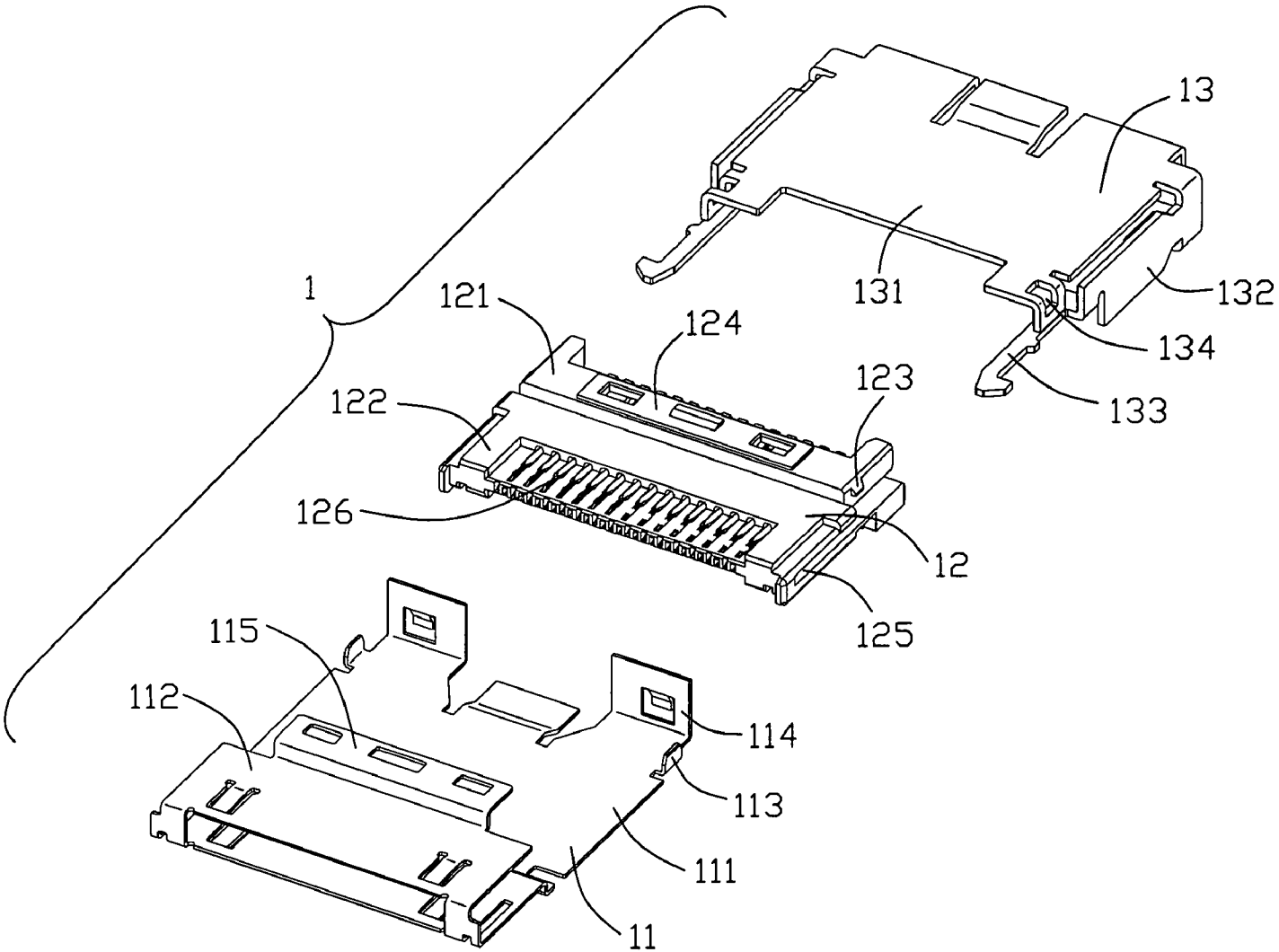
FIG. 4 is an exploded perspective view of the connector member.

As shown in FIG. 4, the insulative housing 12 comprises a base portion 121 and a mating portion 122 extending forward from the base portion 121, a plurality of receiving grooves running through the base portion 121 and the mating portion 122 to receive the conductive terminals 126. The base portion 121 defines a protrusion 123 at each end thereof and an engaging portion 124 on the top surface of the base portion 121. A slot 125 is provided at each end of the mating portion 122 and runs through the base portion 121. The first shell 11 comprises a first flat portion 111 and a second flat portion 112 parallel to the first flat portion 111 and connecting the first flat portion 111 at front ends. The second flat portion 112 further extends rearward to provide a retaining portion 115. The first shell 11 are assembled on the housing 12 with the first flat portion 111 on the bottom of the housing 12 and the second flat portion 112 on the top of the housing 12. The front of the first shell 11 surrounds the mating portion 122 with the retaining portion 115 engaging with the engaging portion 124.

Figure 3:
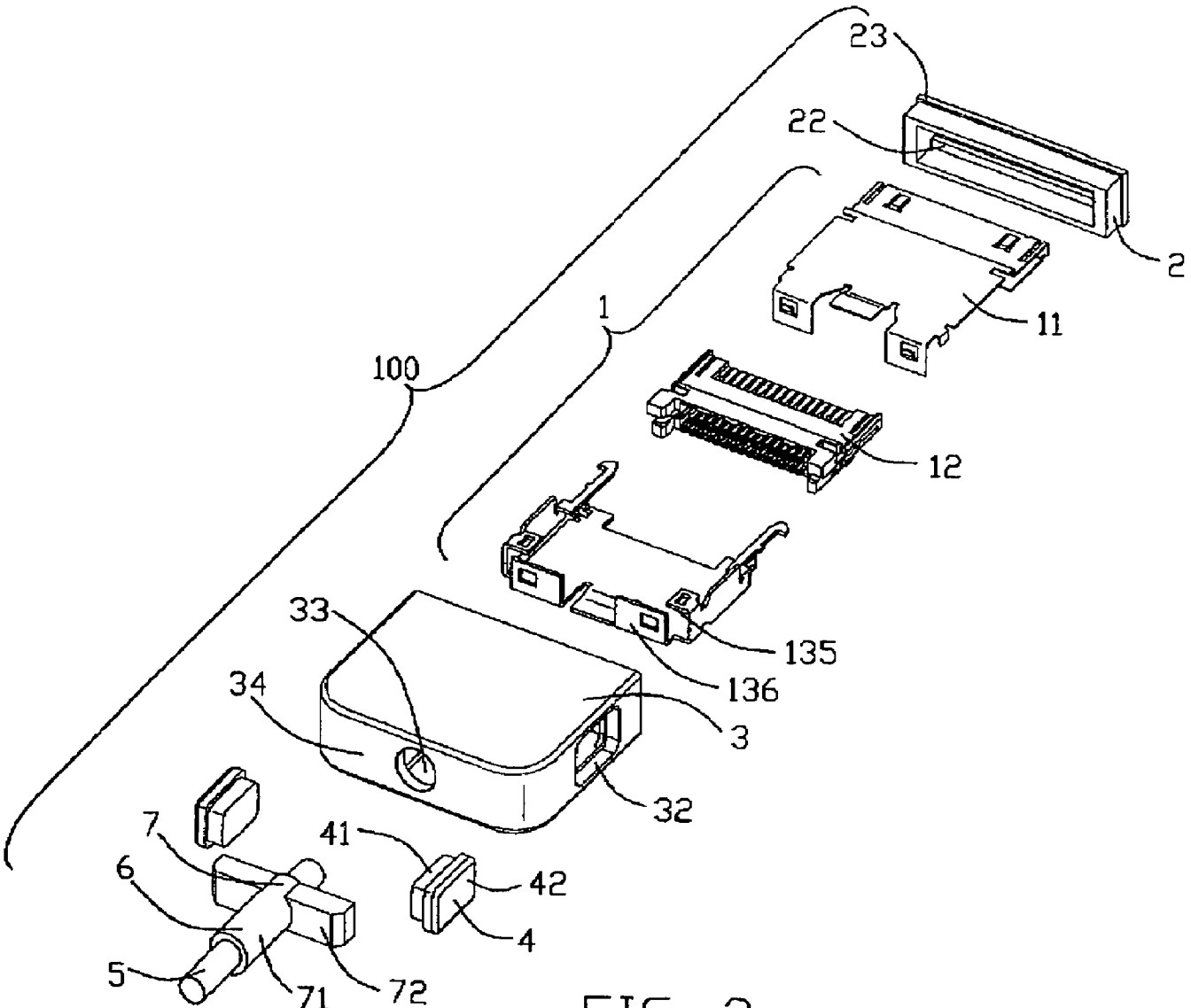
FIG. 3 is another view of the electrical connector of FIG. 2.
Figure 5:
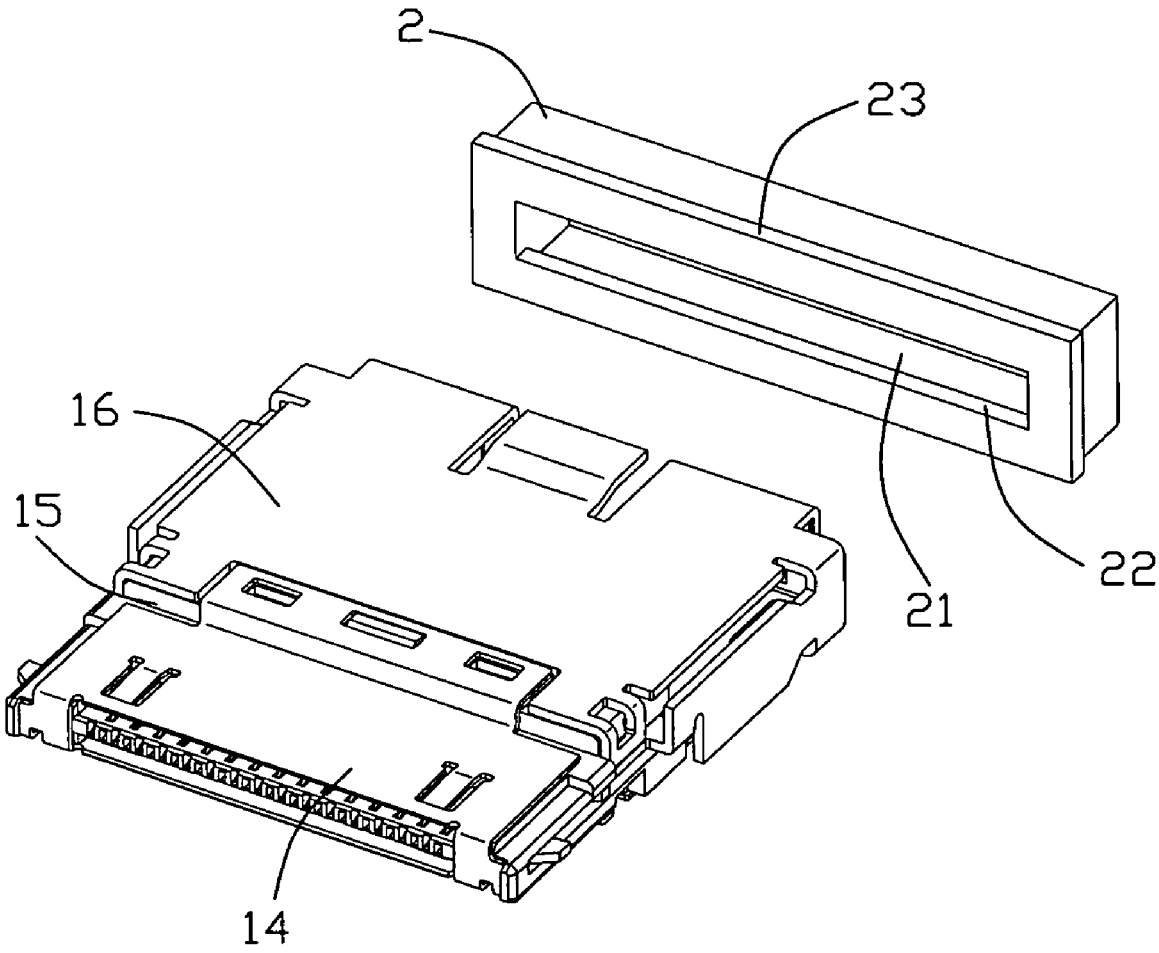
FIG. 5 is a perspective view of the retaining member and the assembled connector member.

The second shell 13 comprises a third flat portion 131 with through holes 134 in sides of the front portion and a pair of sidewalls 132. A locking portion 135 extends inward from each rear end of the bottom of the sidewall 132, and a pair of locking portions 136 bend downwards from the rear end of the third flat portion 131 (best shown in FIG. 3). A latching arm 133 with a hook at free end thereof, transversely extends forward from the front edge of each sidewall 132. The second shell 13 covers the top of the base portion 121. The through holes 134 lock the protrusions 123, and the locking portions 135, 136 are engaged with corresponding locking portions 113, 114, which extend from the first shell 11 at sides and rear of the first flat portion 111. The latching arms 133 are received in the slots 125. Therefore the assembled connector member 1 as shown in FIG. 5 is provided. The connector member 1 comprises a base portion 16 and a mating portion 14 extending forward from the base portion 16. The mating portion 14 is thinner than the base portion 16 so as to provide a stopper portion 15 thereof. The shells 11, 13 are longer than the base portion 121 of the housing 12 for providing a room in the rear portion thereof to shield metal cores of the cable 5 connecting with the terminal 126.

Figure 6:
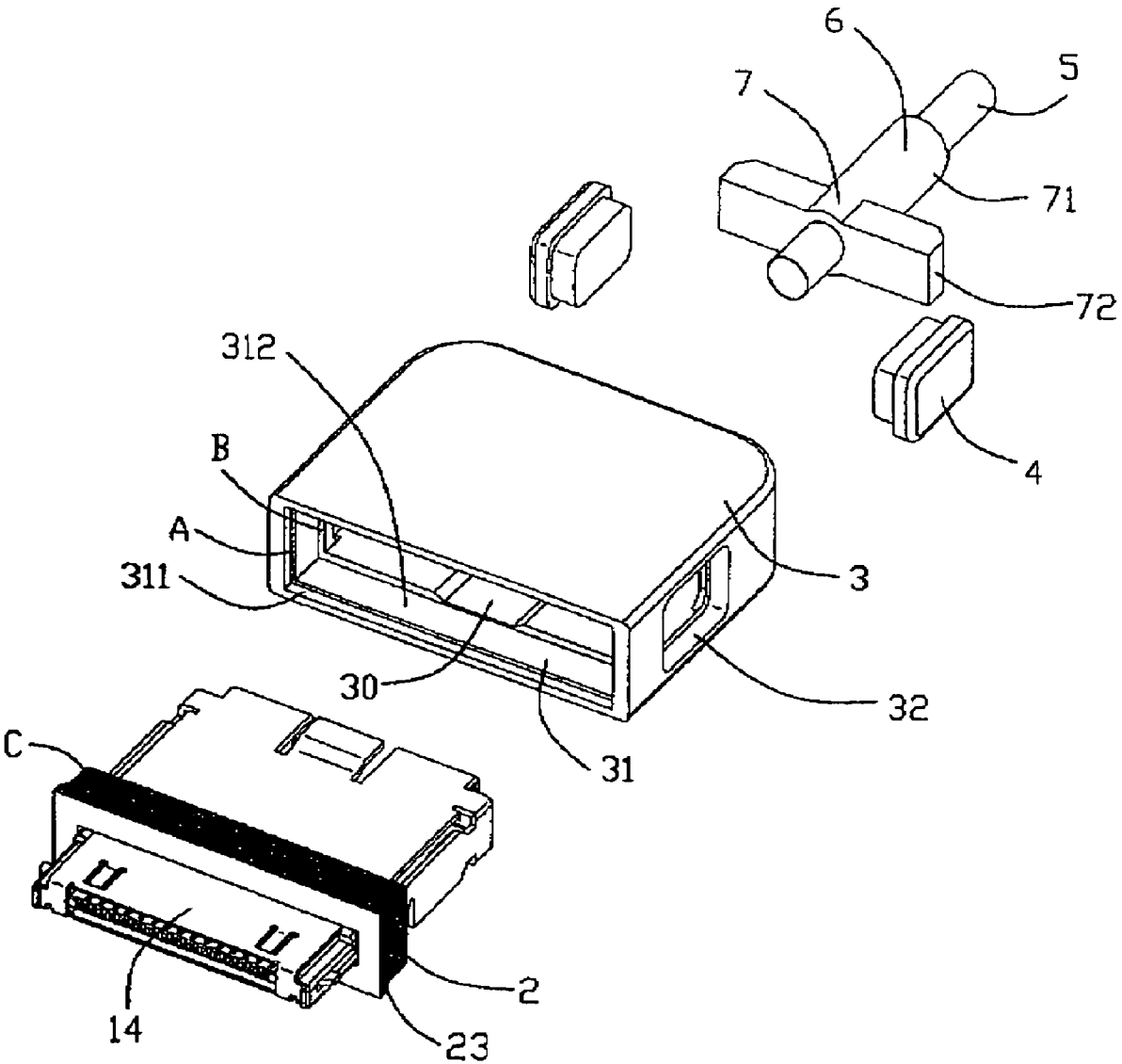
FIG. 6 is a front assembled perspective view of the connector member, the retaining member and the cable assembly of FIG. 2.

As shown in FIG. 5, the retaining member 2 made of insulative material is a longitudinal frame with a through aperture 21 in the centre. A first block portion 22 is provided in the front portion of the aperture 21 and a second block portion 23 is provided at front outside of the frame. As FIG. 6 shown, the connector member 1 passes through the aperture 21 of the retaining member 2 from back to front. The first block portion 22 encounters the stopper portion 15 for preventing the connector member 1 from forwards moving. The back portion of the connector member 1 exposes to the back of the retaining member 2.

Referring to FIG. 6, the single-piece insulative coat 3 defines a receiving cavity 30 therein with an opening. The assembled connector member 1 with the retaining member 2 is inserted into the cavity 30 from the opening. The cavity 30 provides an installation space 31 for receiving the retaining member 2 at the front portion thereof. The installation space 31 comprises a first portion 311 and a smaller second portion 312 adjacent inside of the cavity 30. Different size of the first portion 311 and the second portion 312 provides with a first step face A facing forward therebetween, a second step face B facing forward is provided between the second portion 312 and the adjacent rear portion of receiving cavity 30, the first step face A confronts with the second block portion 23 and the second step face B confronts with the rear portion of the retaining member 2 to prevent the retaining member 2 from further entering into the cavity 30. The insulative coat 3 provides an installation hole 32 in each sidewall and a cable outlet 33 (see FIG. 3) at middle portion of a rear wall 34 thereof so as to let the cable 5 pass through.

The cable assembly 6 comprises a cable 5 and a strain relief member 7 circumferentially fixed on the cable 5. The strain relief member 7 comprises a block member 72 and a boot portion 71 integrally extending reward from the block member 72. The cable outlet 33 is configured to be generally similar shape and size as the boot portion 71 for making the boot portion 71 just passing through. Generally, the insulative coat 3 is assembled in the front-to-rear direction after the cable 5, the connector member 1 and the retaining member 2 are all completely assembled together. The block member 72 of the strain relief member 7 blocks the insulative coat 3 to be assembled in an accurate position avoiding excessive assembly. The boot portion 71 passes through the cable outlet 33 and other parts are meanwhile encased in the receiving cavity 30 except the mating portion 14 for mating with the complementary element, the retaining member 2 is fixed in the installation space 31 by adhesive C (covered by the hatched lines in FIG. 6). Another method such as providing some protrusions on the retaining member 2 and some concaves generally similar shape and size as the protrusions in the installation space 31 also can fix the retaining member 2 in the installation space 31 while the protrusions engaging with the concaves.

The pressing member 4 comprises a contacting portion 41 and an operating portion 42 extending out of the contacting portion 41. The contacting portions 41 are received in holes 32 at sides of the coat 3 and connect with the sidewalls 132. The contacting portion 41 may push the sidewall 132 inward, which will result in the latching arm 133 inward moving to release the complementary connector while a force is exerted on the operating portion 42.

Other embodiments of the present invention are introduced hereafter. The retaining member can be provided as a frame with three webbings, and the insulative coat provides a girder in the front portion of the cavity to engage with the frame. The connector member can only comprise an insulative housing and a pair of latching arms each arranged in one side of the housing. The retaining member can be formed with the housing as one component.

However, the disclosure is illustrative only, changes may be made in detail, especially in matter of shape, size, and arrangement of parts within the principles of the invention.

What is claimed is:

1. An electrical connector, comprising:

a connector member providing a plurality of conductive terminals therein, comprising a base portion and a mating portion extending forward from the base portion;

an insulative coat defining a receiving cavity with a forward opening and an installation space defined in the front of the receiving cavity larger than the receiving cavity in dimension, the installation space defining a first portion and a smaller second portion thereby forming a first step face facing forward and a second step face facing forward between the second portion and the rear portion of the receiving cavity; the base portion of the connector member being received in the receiving cavity; and a retaining member of a frame shape, defining a through aperture in the centre, a block rib around an periphery of the frame adjacent to the forward opening and a rear face, the retaining member being fully received in the installation space and the mating portion extending through the through aperture and out of the forward opening;

wherein the retaining member is fixed in the receiving cavity of the insulative coat to retain the connector member and the insulative coat together steadily, and the first step face confronts with the block rib and the second step face confronts with the rear face of the retaining member to prevent the retaining member from further entering into the cavity.

2. The electrical connector as described in claim 1, wherein the insulative coat is of one single-piece.

3. The electrical connector as described in claim 2, wherein the connector member enters into the receiving cavity in a front-to-rear direction from the opening of the insulative coat, and the retaining member are assembled on the insulative coat in the front-to-rear direction.

4. The electrical connector as described in claim 1, wherein the connector member defines a stopper portion, the retaining member defines a first block portion in a front portion thereof, the first block portion encounters the stopper portion to prevent the connector member from forwards moving.

5. The electrical connector as described in claim 2, wherein the electrical connector further comprises a cable connecting with the connector member, the insulative coat comprises a cable outlet to let the cable pass through.

* * * * *